US008253114B2

(12) United States Patent
Yamashita et al.

(10) Patent No.: US 8,253,114 B2
(45) Date of Patent: Aug. 28, 2012

(54) ION SOURCE

(75) Inventors: Takatoshi Yamashita, Kyoto (JP); Tadashi Ikejiri, Kyoto (JP); Tetsuya Igo, Kyoto (JP)

(73) Assignee: Nissin Ion Equipment Co., Ltd., Kyoto (JP)

( * ) Notice: Subject to any disclaimer, the term of this patent is extended or adjusted under 35 U.S.C. 154(b) by 183 days.

(21) Appl. No.: 12/547,176

(22) Filed: Aug. 25, 2009

(65) Prior Publication Data

US 2010/0051825 A1 Mar. 4, 2010

(30) Foreign Application Priority Data

Aug. 27, 2008 (JP) ..... 2008-218090
May 21, 2009 (JP) ..... 2009-122675

(51) Int. Cl.
*H01J 27/02* (2006.01)

(52) U.S. Cl. ..... 250/423 R; 250/492.2; 250/425

(58) Field of Classification Search ..... 250/423 R, 250/425, 426, 427, 423 P, 423 F; 315/111.81
See application file for complete search history.

(56) References Cited

U.S. PATENT DOCUMENTS 4,424,104 A * 1/1984 Harper et al. ..... 427/523
5,382,801 A * 1/1995 Kanayama ..... 250/423 R
6,239,440 B1 * 5/2001 Abbott ..... 250/423 R
6,661,014 B2 * 12/2003 Reyes ..... 250/423 R
6,686,601 B2 * 2/2004 Murrell et al. ..... 250/492.21
6,777,686 B2 * 8/2004 Olson et al. ..... 250/423 R
6,818,909 B2 * 11/2004 Murrell et al. ..... 250/492.2
6,872,959 B2 * 3/2005 Nishigami ..... 250/492.3
7,718,978 B2 * 5/2010 Yamashita ..... 250/423 R
7,724,492 B2 * 5/2010 Botvinnik ..... 361/230
7,791,041 B2 * 9/2010 Yamashita et al. ..... 250/423 R
7,820,981 B2 * 10/2010 Horsky et al. ..... 250/425
2001/0037817 A1 * 11/2001 Abbott ..... 134/1.3
2005/0173651 A1 * 8/2005 Goldberg et al. ..... 250/426
2006/0076505 A1 * 4/2006 Fischer et al. ..... 250/423 P
2008/0042580 A1 * 2/2008 Horsky ..... 315/111.81
2008/0067412 A1 * 3/2008 Vanderberg et al. ..... 250/427
2008/0223409 A1 * 9/2008 Horsky et al. ..... 134/22.1
2010/0015878 A1 * 1/2010 Miyabayashi ..... 445/35
2010/0038556 A1 * 2/2010 Miyamoto ..... 250/423 R
2010/0107980 A1 * 5/2010 Horsky et al. ..... 118/723 E

FOREIGN PATENT DOCUMENTS

JP 3325393 7/2002

* cited by examiner

*Primary Examiner* — David A Vanore
*Assistant Examiner* — Wyatt Stoffa
(74) *Attorney, Agent, or Firm* — Osha Liang LLP

(57) ABSTRACT

An ion source includes a plasma generating chamber into which an ionization gas containing fluorine is introduced, a hot cathode provided on one side in the plasma generating chamber, an opposing reflecting electrode which is provided on other side in the plasma generating chamber and reflects electrons when a negative voltage is applied from a bias power supply to the opposing reflecting electrode, and a magnet for generating a magnetic field along a line, which connects the hot cathode and the opposing reflecting electrode, in the plasma generating chamber. The opposing reflecting electrode is formed of an aluminum containing material.

14 Claims, 6 Drawing Sheets

ION SOURCE

TECHNICAL FIELD

The present disclosure relates to an ion source which is employed in an ion implantation apparatus that implants aluminum ions into a target such as a silicon carbide (SiC) substrate, or the like, for example, and generates an ion beam containing the aluminum ions.

RELATED ART

An example of the ion source of this type is set forth in Patent Literature 1.

In the related-art ion source set forth in Patent Literature 1, a plate formed of the aluminum containing material (e.g., aluminum oxide) is provided in the ionization chamber apart from an electrode (cathode) and a recoil plate as the components used for the plasma generation/confinement, and the plasma being generated by ionizing a fluoride gas (e.g., silicon tetrafluoride) is caused to erode the plate formed of the aluminum containing material such that the aluminum ions are emitted into the plasma.

[Related Art Literature]

[Patent Literature]

[Patent Literature 1] Japanese Patent No. 3325393 (paragraphs 0006-0011, 0016-0021, FIG. 1, FIG. 2)

In the related-art ion source, the plate formed of the aluminum containing material and used exclusively to generate the aluminum ions must be provided apart from the components used for the plasma generation/confinement. Therefore, such a problem exists that the number of items is increased correspondingly and a structure becomes complicated.

SUMMARY

Exemplary embodiments of the present invention to provide an ion source that generates an ion beam containing aluminum ions, in which a reduction of the number of items and a simplification of the structure in the ion source can be attained.

An ion source for generating an ion beam containing an aluminum ion, according to an exemplary embodiment of the invention, includes:

a plasma generating chamber which is also used as an anode and generates a plasma in an interior, and into which an ionization gas containing fluorine is introduced;

a hot cathode provided on one side in the plasma generating chamber and isolated electrically from the plasma generating chamber;

an opposing reflecting electrode which is provided on other side in the plasma generating chamber to oppose to the hot cathode and is isolated electrically from the plasma generating chamber, to which a voltage that is negative in contrast to a potential of the plasma generating chamber is applied, and which reflects electrons in the plasma generating chamber and is formed of an aluminum containing material; and a magnet which generates a magnetic field along a line connecting the hot cathode and the opposing reflecting electrode, in the plasma generating chamber.

In place of the application of the negative voltage to the opposing reflecting electrode, the opposing reflecting electrode may be set to a floating potential.

According to the exemplary embodiment of the invention, the aluminum particles such as the aluminum ions, etc. can be emitted into the plasma from the opposing reflecting electrode that has a function of reflecting the electrons in the plasma generating chamber such that the aluminum ions can be contained in the plasma. Therefore, unlike the foregoing ion source in the related art, there is no need to provide particularly the plate that is used exclusively to generate the aluminum ions. As a result, a reduction of the number of items and a simplification of the structure of the ion source can be attained.

Also, the magnet for generating the magnetic field along the line that connects the hot cathode and the opposing reflecting electrode is provided. Therefore, the electrons in the plasma generating chamber reciprocally moves between the hot cathode and the opposing reflecting electrode, so that the high-density plasma can be generated between the hot cathode and the opposing reflecting electrode. The opposing reflecting electrode is positioned at the edge portion of such high-density plasma, and the plasma is ready to move in the direction along the magnetic field and the opposing reflecting electrode is positioned at the edge portion in the easily moving direction. Therefore, the opposing reflecting electrode is exposed effectively to the high-density plasma. Accordingly, the aluminum particles such as the aluminum ions, or the like can be emitted effectively into the plasma from the opposing reflecting electrode. As a result, it is made easy to increase an amount of aluminum ions contained in the ion beam.

The above-mentioned ion source further includes:

a backside reflecting electrode which is provided at a back of an electron emitting portion of the hot cathode in the plasma generating chamber to oppose to the opposing reflecting electrode, which is isolated electrically from the plasma generating chamber, to which a voltage that is negative in contrast to the potential of the plasma generating chamber is applied, and which reflects the electrons in the plasma generating chamber and is formed of an aluminum containing material.

In place of the application of the negative voltage to the backside reflecting electrode, the backside reflecting electrode may be set to a floating potential.

According to the exemplary embodiment of the invention, further advantages described hereunder can be achieved. That is, the aluminum particles are emitted into the plasma not only from the opposing reflecting electrode but also the backside reflecting electrode by the erosion, the sputtering, and the like caused by the fluorine ions in the plasma. Therefore, an amount of aluminum ions contained in the ion beam can be increased by increasing an amount of aluminum particles that are emitted into the plasma.

Also, the hot cathode is provided in vicinity of the backside reflecting electrode, and thus a temperature of the backside reflecting electrode is increased by a radiant heat from the hot cathode. As a result, an improvement of a sputter ratio and an increase of a vapor pressure of the aluminum containing material can be expected, and thus an amount of aluminum particles that are emitted into the plasma can be increased. Therefore, an amount of aluminum ions contained in the ion beam can be increased from this viewpoint.

Also, in the case of this invention, the backside reflecting electrode having a function of reflecting the electrons in the plasma generating chamber is also used as the aluminum particle emitting electrode. Therefore, unlike the ion source in the related art, there is no necessity that the plate used exclusively to generate the aluminum ions should be particularly provided. As a result, a reduction of the number of items and a simplification of the structure of the ion source can be attained in contact to the case where such plate is particularly provided.

In the above-mentioned ion source, the hot cathode is an indirectly heated type hot cathode which has a cathode member which emits thermions by a heating and a filament which heats the cathode member, the cathode member being arranged in an opening portion of the plasma generating chamber, and a wall surface containing the opening portion of the plasma generating chamber is formed of an electric insulating aluminum containing material.

The wall surface containing the opening portion of the plasma generating chamber may be formed of an aluminum containing material.

Alternatively, the wall surface formed of an aluminum containing material may be set to a floating potential or, a voltage that is negative in contrast to the potential of the plasma generating chamber may be applied to the wall surface.

According to the exemplary embodiment of the invention, further advantages described hereunder can be achieved. That is, the aluminum particles are emitted into the plasma not only from the opposing reflecting electrode but also the wall surface formed of the aluminum containing material of the plasma generating chamber by the erosion, the sputtering, and the like caused by the fluorine ions in the plasma. Therefore, an amount of aluminum ions contained in the ion beam can be increased by increasing an amount of aluminum particles that are emitted into the plasma.

Also, the hot cathode is provided in vicinity of the wall surface formed of the aluminum containing material, and thus a temperature of the wall surface formed of the aluminum containing material is increased by a radiant heat from the hot cathode. As a result, an improvement of a sputter ratio and an increase of a vapor pressure of the aluminum containing material can be expected, and thus an amount of aluminum particles that are emitted into the plasma can be increased. Therefore, an amount of aluminum ions contained in the ion beam can be increased from this viewpoint.

Also, in the case of this invention, a part of the wall surface constituting the aluminum generating chamber, i.e., the wall surface containing the opening portion, is also used as the aluminum particle emitting electrode. Therefore, unlike the ion source in the related art, there is no necessity that the plate used exclusively to generate the aluminum ions should be particularly provided. As a result, a reduction of the number of items and a simplification of the structure of the ion source can be attained in contact to the case where such plate is particularly provided.

Other features and advantages may be apparent from the following detailed description, the accompanying drawings and the claims.

DETAILED DESCRIPTION

Figure 1:
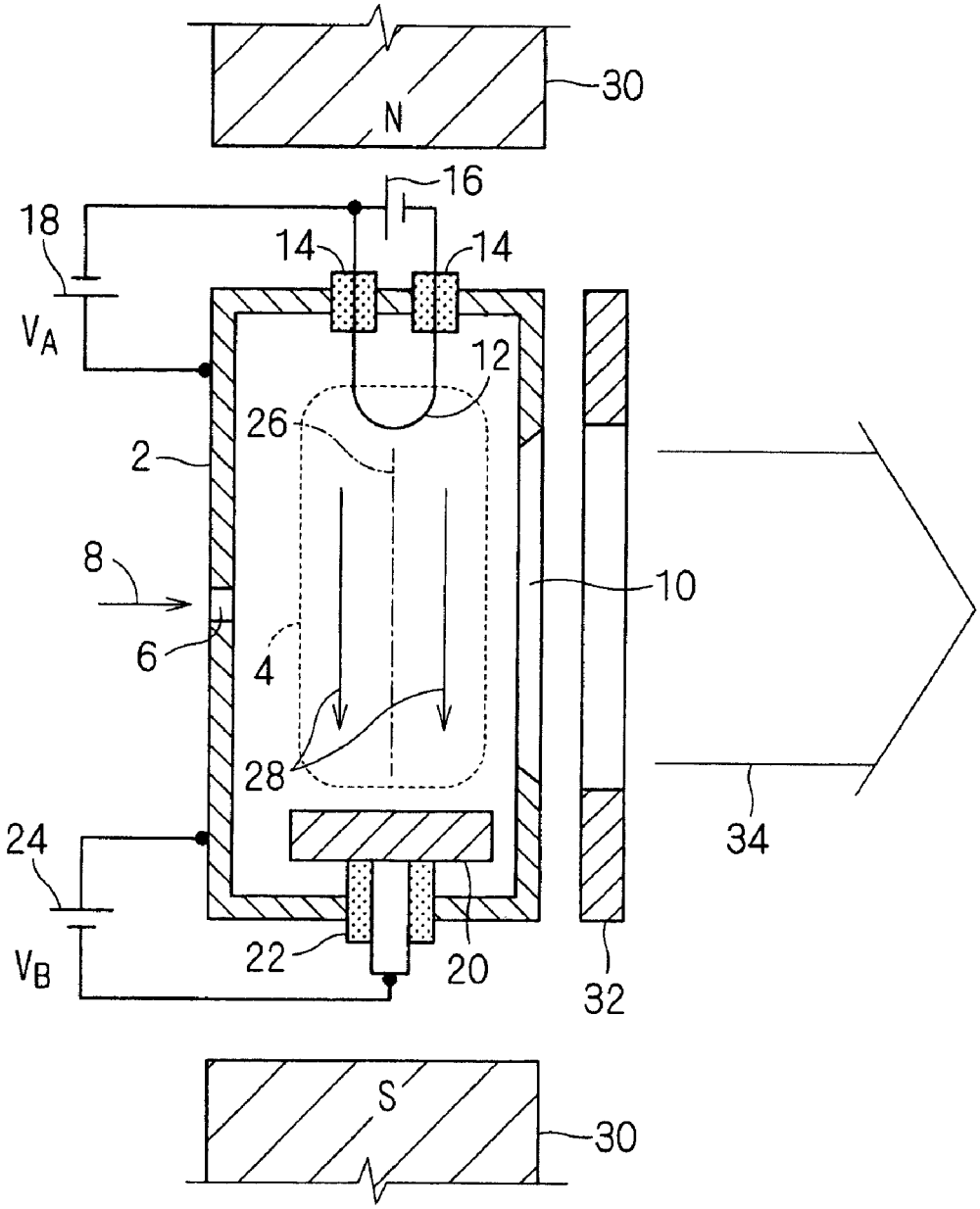
FIG. 1 is a schematic sectional view showing an embodiment of an ion source according to this invention.

FIG. 1 is a schematic sectional view showing an embodiment of an ion source according to this invention. This ion source is the ion source that generates (extracts out) an ion beam 34 containing aluminum ions, and is equipped with a plasma generating chamber 2 that is used to generate a plasma 4 in an interior and also serves as an anode for an arc discharge. This plasma generating chamber 2 is shaped into a rectangular parallelepiped, for example, but the shape is not limited to this shape.

An ionization gas 8 containing fluorine is introduced into the plasma generating chamber 2 through a gas inlet port 6. The position of the gas inlet port 6 is not limited to a position in the illustrate example. The reason why the ionization gas 8 containing fluorine is used is that, since the fluorine has a very strong chemical action and has a strong reactivity with other materials, the plasma 4 generated by ionizing the ionization gas 8 containing fluorine has a strong action to emit aluminum particles such as aluminum ions, or the like from an opposing reflecting electrode 20 described later.

As the ionization gas 8 containing fluorine, a fluoride gas such as boron fluoride ($BF_3$), silicon tetrafluoride ($SiF_4$), germanium fluoride ($GeF_4$), or the like, or a gas containing fluorine ($F_2$), for example, is employed. As the ionization gas 8 containing fluorine, for example, the fluoride gas itself or the fluorine itself may be employed, or their diluted gas diluted with an appropriate gas (e.g., helium gas) may be employed.

A hot cathode 12 is provided on one side in the plasma generating chamber 2. This hot cathode 12 is electrically isolated from the plasma generating chamber 2, and emits thermions into the plasma generating chamber 2.

As the hot cathode 12, the directly heated type as shown in this embodiment may be employed or the indirectly heated type as shown in an embodiment described later (see FIG. 3, or the like) may be employed.

In this embodiment, the hot cathode 12 is a U-shaped filament, and is electrically isolated from the plasma generating chamber 2 with an insulator 14. In this case, a direction of the filament is shown for convenience sake to clarify the connection to a DC heating power supply 16. Actually, this filament is arranged such that a plane containing the U-shaped filament is positioned in substantially parallel with an ion extracting port 10 described later. This is also true in another embodiment shown in FIG. 2. In this case, the filament may be shaped other than the U-shape.

The DC heating power supply 16 for heating the hot cathode 12 is connected across the hot cathode 12. A DC arc power supply 18 is connected between one end of the hot cathode 12 and the plasma generating chamber 2 such that its positive electrode side is directed to the plasma generating chamber 2. This arc power supply 18 applies an arc voltage $V_A$ between the hot cathode 12 and the chamber 2 to generate an arc discharge in such a manner that the ionization gas 8 introduced into the plasma generating chamber 2 is ionized to generate the plasma 4.

The opposing reflecting electrode 20 is provided on the other side (the opposite side to the hot cathode 12) in the plasma generating chamber 2. This opposing reflecting electrode 20 is provided to oppose to the hot cathode 12, and has a function of reflecting (in other words, repelling or repulsing. Ditto with the followings) the electrons in the plasma generating chamber 2 (mainly, the thermions emitted from the hot cathode 12. Ditto with the followings). This opposing reflecting electrode 20 is isolated electrically from the plasma generating chamber 2 with an insulator 22.

In this embodiment, a bias voltage $V_B$ that is negative in contrast to a potential of the plasma generating chamber 2 is applied to the opposing reflecting electrode 20 from a DC bias power supply 24. A magnitude of the bias voltage $V_B$ may be decided with regard to a balance among an action of reflecting the electrons by the opposing reflecting electrode 20, an action of emitting the aluminum particles such as the aluminum ions, or the like from the opposing reflecting electrode 20, an action of sputtering the surface of the opposing reflecting electrode 20 by the ions in the plasma 4, etc. From such viewpoint, it is preferable that a magnitude of the bias voltage $V_B$ should be set to about 40 V to 150 V, for example. When the ionization gas 8 is the gas containing the boron fluoride ($BF_3$), the magnitude of about 60 V to 120 V out of them is more preferable.

The opposing reflecting electrode in the publicly known ion source is formed of a refractory metal such as titanium (Ti), tantalum (Ta), molybdenum (Mo), or the like, or their alloy. But the above opposing reflecting electrode 20 is formed of the aluminum containing material. The aluminum containing material is an aluminum compound such as aluminum oxide ($Al_2O_3$), aluminum nitride (AlN), or the like, for example. Also, the aluminum (Al) can be employed when a temperature control is applied.

A magnet 30 is provided on the outside of the plasma generating chamber 2. The magnet 30 generates a magnetic field 28 along a line 26 that connects the hot cathode 12 and the opposing reflecting electrode 20. The magnet 30 is formed of an electromagnet, for example, but a permanent magnet may also be employed. A direction of the magnetic field 28 may be set in the opposite direction to that in the illustrated example.

Because of the foregoing presence of the opposing reflecting electrode 20 and the magnetic field 28, the electrons in the plasma generating chamber 2 move reciprocally between the hot cathode 12 and the opposing reflecting electrode 20 while turning in the magnetic field 28 around an axis in the direction of the magnetic field 28. As a result, a collision probability between the electrons and gas molecules of the ionization gas 8 is enhanced, then an ionization efficiency of the ionization gas 8 is increased, and thus a generation efficiency of the plasma 4 is increased. More concretely, the high-density plasma 4 can be generated between the hot cathode 12 and the opposing reflecting electrode 20.

The ion extracting port 10 used to extract out the ions from the plasma 4 is provided in the wall surface of the plasma generating chamber 2. In this embodiment, the ion extracting port 10 has a long and narrow shape in the direction along the line 26. More concretely, this port 10 is shaped into a long slit in the direction along the line 26. However, the shape of the ion extracting port 10 is not limited to this shape.

A extracting electrode system 32 is provided near the outlet of the ion extracting port 10. The extracting electrode system 32 is used to extract out the ion beam 34 from the plasma generating chamber 2 (more concretely, from the plasma 4 generated there). The extracting electrode system 32 is constructed by a sheet of electrode in the illustrated example. But this extracting electrode system 32 is not limited to this, and this extracting electrode system 32 may be constructed by plural sheets of electrodes.

In this ion source, the opposing reflecting electrode 20 formed of the aluminum containing material is exposed to the plasma 4 that is generated by ionizing the ionization gas 8 containing the fluorine. On account of the erosion caused by the fluorine ion, the fluorine radical, and the like in the plasma 4, the sputtering caused by the ions such as the fluorine ion, and the like in the plasma 4, etc., the aluminum particles such as the aluminum ions, or the like are emitted from the opposing reflecting electrode 20, and the aluminum ions are contained in the plasma 4. The aluminum particles emitted from the opposing reflecting electrode 20 may be emitted as the aluminum ions or emitted as the neutral aluminum atoms. The neutral aluminum atoms collide with the electrons in the plasma 4 to some extent, and are ionized into the aluminum ions. In this manner, the aluminum ions (e.g., $Al^{+}$, $Al^{2+}$, $Al^{3+}$. Ditto with the followings) are contained in the plasma 4. As a result, the ion beam 34 containing the concerned aluminum ions can be generated.

In this manner, according to this ion source, the aluminum particles such as the aluminum ions, and the like can be emitted into the plasma 4 from the opposing reflecting electrode 20 that has a function of reflection the electrons in the plasma generating chamber 2, and the aluminum ions can be contained in the plasma 4. In other words, the opposing reflecting electrode 20 that reflects the electrons in the plasma generating chamber 2 is also used for the purpose of emitting the aluminum particles. Therefore, unlike the foregoing ion source in the related art, there is no need to provide particularly the plate that is used exclusively to generate the aluminum ions. As a result, a reduction of the number of items and a simplification of the structure of the ion source can be attained.

In addition, the magnet 30 for generating the magnetic field 28 along the line 26 that connects the hot cathode 12 and the opposing reflecting electrode 20 is provided. Therefore, the electrons in the plasma generating chamber 2 moves reciprocally between the hot cathode 12 and the opposing reflecting electrode 20, as described above. The plasma 4 can be generated at a high density between the hot cathode 12 and the opposing reflecting electrode 20. The opposing reflecting electrode 20 is positioned at the end portion of such high-density plasma 4, the plasma 4 is easily movable in the direction along the magnetic field 28, and the opposing reflecting electrode 20 is positioned at the end portion in the easily movable direction. Therefore, the opposing reflecting electrode 20 can be exposed effectively to the high-density plasma 4. Accordingly, the aluminum particles such as the aluminum ions, and the like can be emitted effectively into the plasma 4 from the opposing reflecting electrode 20. As a result, it can be made easy that an amount of aluminum ions contained in the ion beam 34 is increased.

In the foregoing ion source in the related art, the plate formed of the aluminum containing material is fitted on the bottom surface of the ionization chamber. The opposing reflecting electrode 20 can be exposed more effectively to the plasma 4 than the plate located in such position in connection to the magnetic field 28. Therefore, the aluminum particles such as the aluminum ions, and the like can be emitted more effectively into the plasma 4. In turn, the ion beam 34 containing a larger amount of aluminum ions can be generated.

Normally, the unnecessary particles are stacked on the surfaces, which are exposed to the plasma 4, including the surface of the opposing reflecting electrode 20 along with the operation of the ion source, i.e., along with the generation of the plasma 4. When the opposing reflecting electrode 20 is observed particularly, the bias voltage $V_B$ that is negative with respect to the plasma generating chamber 2 is applied to the opposing reflecting electrode 20. Therefore, the opposing reflecting electrode 20 can achieve the action of accelerating the ions in the plasma 4 by the bias voltage $V_B$ to pull in them, in addition to the above action of reflecting the electrons. The particles stacked on the surface of the opposing reflecting electrode 20 are sputtered by the accelerated ions, and thus the surface of the opposing reflecting electrode 20 can be cleaned. Therefore, the action of exposing the surface itself of the opposing reflecting electrode 20 and emitting the aluminum particles from the surface can be maintained stably for a longer time.

In contrast, the foregoing ion source in the related art is not constructed such that the negative voltage in contrast to the ionization chamber is applied to the plate formed of the aluminum containing material (or this plate is set to a floating potential). Therefore, such an action is not expected that the particles stacked on the surface of the concerned plate are sputtered by the accelerated ions and thus the surface of the concerned plate is cleaned. As a result, a function of emitting the aluminum particles from the concerned plate is quickly lowered.

The opposing reflecting electrode 20 is exhausted after the aluminum particles are emitted from the opposing reflecting electrode 20. Therefore, the opposing reflecting electrode 20 may be exchanged as occasion demands. This respect is similar to the case of the plate in the foregoing ion source in the related art.

By the way, when the aluminum ions are implanted into the target such as the silicon carbide substrate, or the like by using this ion source as the ion implantation apparatus, a mass separator that selects the aluminum ions of a necessary momentum by separating a momentum (e.g., mass) of the ion beam 34 may be provided between the ion source and the target, as occasion demands. This is also true of the case where the ion source in the embodiment described hereunder is employed.

Next, several other embodiments of the ion source according to this invention will be explained hereunder. Here, in the explanation of respective following embodiments, the same reference symbols are affixed to the same or equivalent portions as or to those in the embodiment explained previously (for example, the embodiment shown in FIG. 1). Mainly differences from the embodiment explained previously will be explained hereunder.

Figure 2:
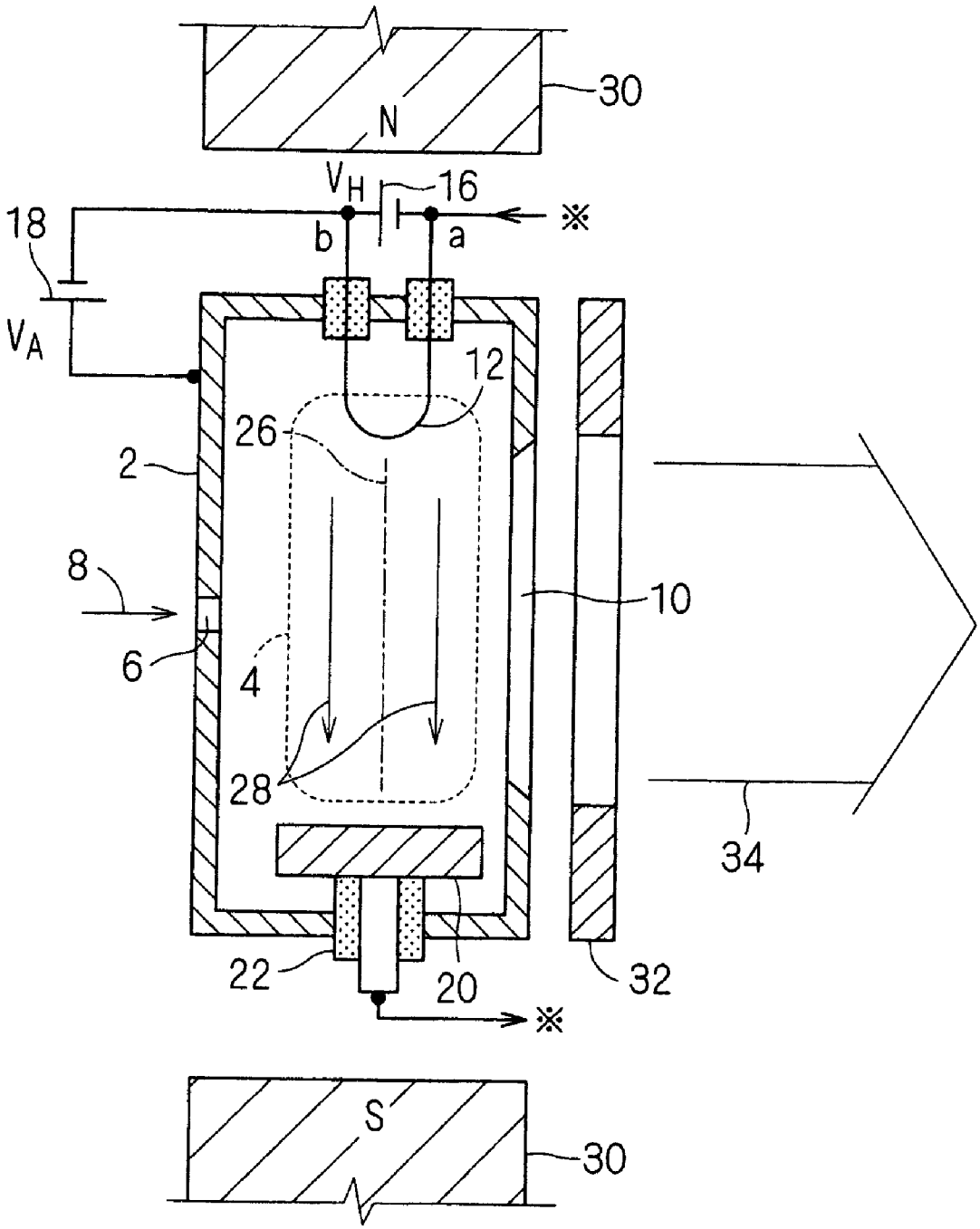
FIG. 2 is a schematic sectional view showing another embodiment of an ion source according to this invention.

Instead of the provision of the above bias power supply 24, the opposing reflecting electrode 20 may be connected to the hot cathode 12 and may be fixed at the cathode potential, like the embodiment shown in FIG. 2. More concretely, the opposing reflecting electrode 20 may be connected to (a) connection portion a between the negative electrode of the heating power supply 16 and one end of the hot cathode 12, like the example shown in FIG. 2, or (b) a connection portion b between the positive electrode of the heating power supply 16 and the other end of the hot cathode 12 (i.e., the negative electrode of the arc power supply 18). In either case, the negative voltage that is negative in contrast to the potential of the plasma generating chamber 2 can be applied to the opposing reflecting electrode 20. Concretely, in the case of (a), the negative voltage of a magnitude of $V_A+V_H$ can be applied and, in the case of (b), the negative voltage of a magnitude of $V_A$ can be applied. Where $V_A$ denotes an arc voltage as the output voltage of the arc power supply 18, and $V_H$ denotes the output voltage of the heating power supply 16. A magnitude of the arc voltage $V_A$ is set to about 40 V to 120 V, for example, and a magnitude of the output voltage $V_H$ is set to about 2 V to 4 V, for example.

In the case of (a), the heating power supply 16 and the arc power supply 18 are also used as the DC power supply that applies the negative voltage to the opposing reflecting electrode 20. In the case of (b), the arc power supply 18 is also used as the DC power supply that applies the negative voltage to the opposing reflecting electrode 20. The AC power supply may be employed as the heating power supply 16. In such case, the above (b) may be employed.

In the case of this embodiment, the negative voltage that is negative in contrast to the potential of the plasma generating chamber 2 can be applied to the opposing reflecting electrode 20. Therefore, the almost similar advantages of the opposing reflecting electrode 20 to the case in the embodiment shown in FIG. 1 can be achieved.

In place of the application of the negative voltage to the opposing reflecting electrode 20, the opposing reflecting electrode 20 may not be connected electrically to any portion and may be set to a floating potential. Even when the opposing reflecting electrode 20 is set to a floating potential, the electrons whose mass is lighter than the ions in the plasma 4 and whose mobility is higher that such ions are incident on the opposing reflecting electrode 20 in an amount that is greater than the ions. Therefore, the opposing reflecting electrode 20 is charged negatively, and the similar action to the case where the negative voltage is applied to the opposing reflecting electrode 20 can be achieved. That is, the substantially similar advantages of the opposing reflecting electrode 20 to those in the case of the embodiments shown in FIG. 1 and FIG. 2 can be achieved.

Here, (a) the bias power supply 24 is provided like the embodiment shown in FIG. 1, (b) the opposing reflecting electrode 20 is connected to the hot cathode 12 like the embodiment shown in FIG. 2, and (c) the opposing reflecting electrode 20 is not connected to any portion and is set to a floating potential are compared mutually. In the case of (a), the bias voltage $V_B$ can be chosen freely, and therefore the optimum voltage for the aluminum ion generation, and the like can be applied easily to the opposing reflecting electrode 20. In the case of (b), the arc power supply 18, etc. are also used as the power supply that is used to apply the negative voltage to the opposing reflecting electrode 20. Therefore, the power supply used exclusively for the opposing reflecting electrode 20 is not needed, and thus a configuration of the power supply can be simplified. Also, a potential of the opposing reflecting electrode 20 can be fixed. In the case of (c), the power supply used exclusively for the opposing reflecting electrode 20 is not needed, and thus a configuration of the power supply can be simplified. It is possible to say that the similar situation is true of other embodiments described later.

Figure 3:
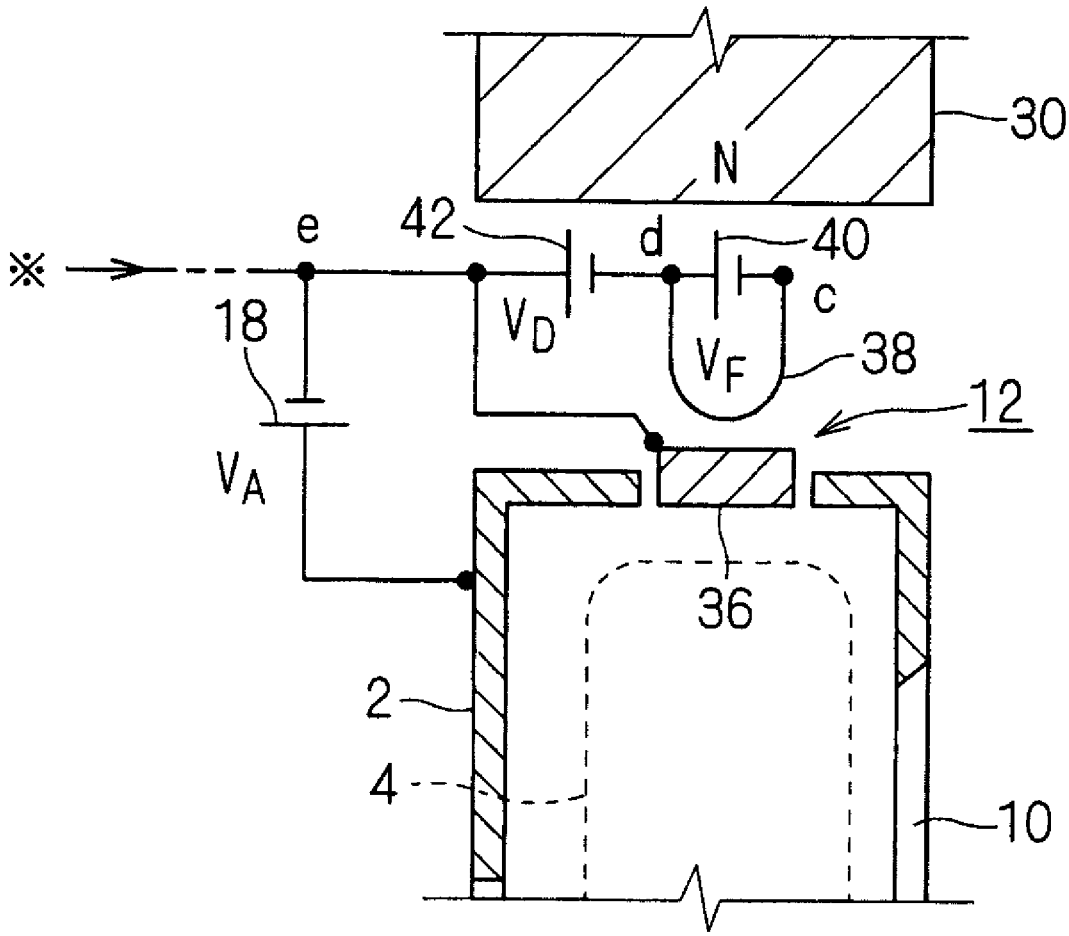
FIG. 3 is a schematic sectional view showing an embodiment when a hot cathode is of an indirectly heated type.

As described later, the indirectly heated type may be employed as the hot cathode 12. An example is shown in FIG. 3.

The hot cathode 12 has a cathode member 36 for emitting the thermions when heated, and a filament 38 for heating the cathode member 36. A concrete structure that the cathode member 36 and the filament 38 are arranged in the plasma generating chamber 2 is shown in FIG. 3 in a simplified mode. The publicly known structure as set forth in Japanese Patent No. 3758667, for example, may be employed. This is similarly applied to the embodiments shown in FIG. 5 to FIG. 7.

A DC heating power supply 40 for heating the filament 38 is connected to the filament 38. ADC bombard power supply 42 is connected between the filament 38 and the cathode member 36 to direct its positive electrode side to the cathode member 36. This bombard power supply 42 accelerates the thermions emitted from the filament 38 toward the cathode member 36 and heats the cathode member 36 by utilizing the impact of the thermions. The above-mentioned arc power supply 18 is connected between the cathode member 36 and the plasma generating chamber 2.

When the indirectly heated hot cathode 12 is provided, the bias voltage $V_B$ may be applied to the opposing reflecting electrode 20 or the opposing reflecting electrode 20 may be connected to the hot cathode 12 and may be fixed at the cathode potential. More concretely, the opposing reflecting electrode 20 may be connected to (a) a connection portion c between the negative electrode of the heating power supply 40 and one end of the filament 38, (b) a connection portion d between the positive electrode of the heating power supply 40 and the other end of the filament 38, and (c) a connection portion e between the cathode member 36 and the arc power supply 18 (i.e., the negative electrode of the arc power supply 18), as indicated with a chain double-dashed line in FIG. 3. In either case, the negative voltage that is negative in contrast to the potential of the plasma generating chamber 2 can be applied to the opposing reflecting electrode 20. Concretely, the negative voltage of a magnitude of $V_A+V_D+V_F$ can be applied in the case of (a), the negative voltage of a magnitude of $V_A+V_D$ can be applied in the case of (b), and the negative voltage of a magnitude of $V_A$ can be applied in the case of (c). Where $V_A$ denotes the above arc voltage, $V_D$ denotes the output voltage of the bombard power supply 42, and $V_F$ denotes the output voltage of the heating power supply 40. A magnitude of the arc voltage $V_A$ is set to about 40 V to 120 V as described above, for example, a magnitude of the output voltage $V_F$ is set to about 2 V to 4 V, for example, and a magnitude of the output voltage $V_D$ is set to about 300 V to 600 V, for example.

In the case of (a), the arc power supply 18, the bombard power supply 42, and the heating power supply 40 are also used as the DC power supply that applied the negative voltage to the opposing reflecting electrode 20. In the case of (b), the arc power supply 18 and the bombard power supply 42 are also used as the DC power supply that applied the negative voltage to the opposing reflecting electrode 20. In the case of (c), the arc power supply 18 is also used as the DC power supply that applied the negative voltage to the opposing reflecting electrode 20. An AC power supply may also be employed as the heating power supply 40. In such case, the above case of (b) or (c) may be employed.

Figure 4:
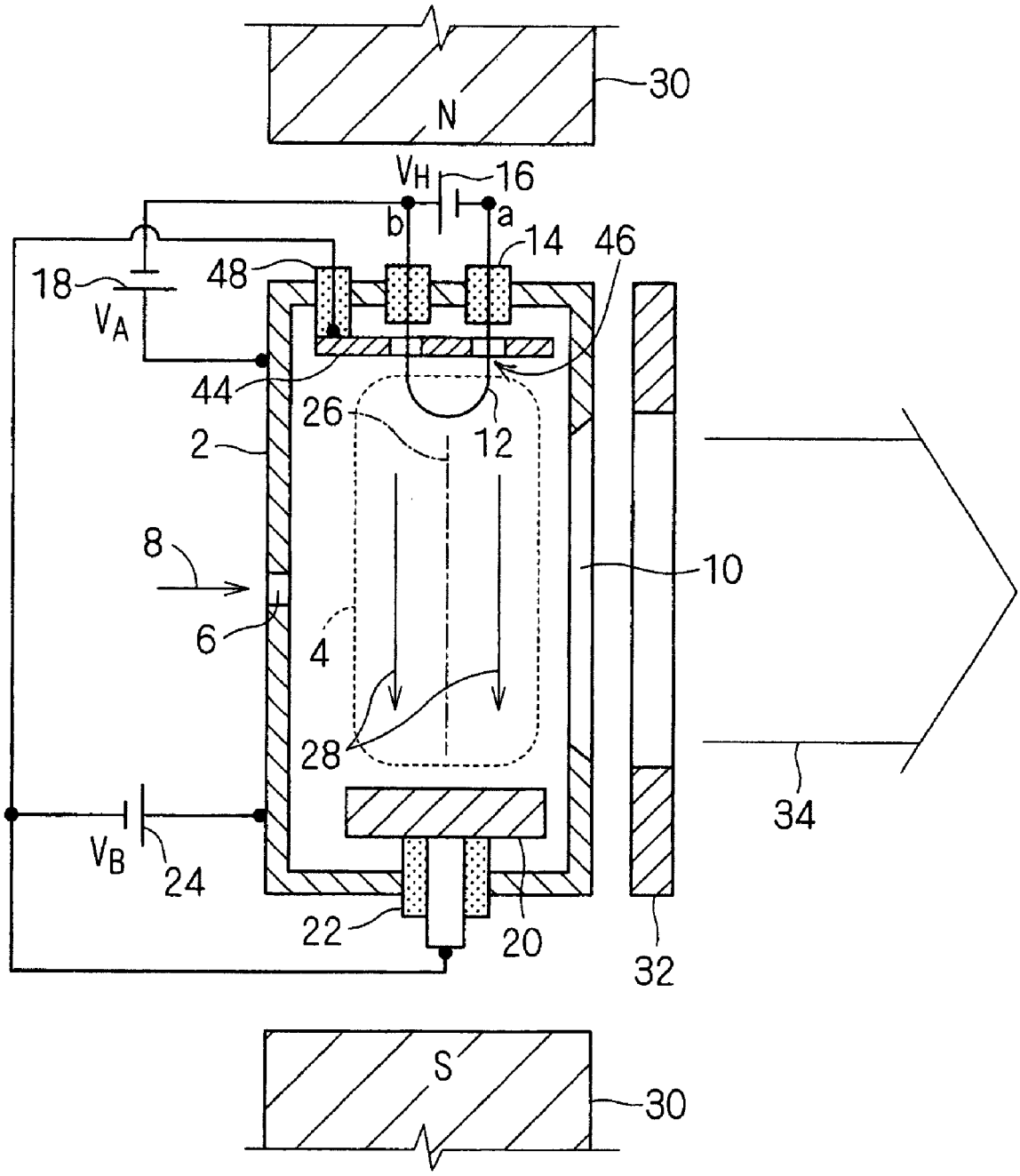
FIG. 4 is a schematic sectional view showing still another embodiment of an ion source according to this invention.

Meanwhile, as set forth in Japanese Patent No. 3797160, for example, some ion sources are equipped with the reflecting electrode (backside reflecting electrode) on the hot cathode side, in addition to the opposing reflecting electrode 20. In this case, as described above, both reflecting electrodes in the publicly known ion source are formed of not the aluminum containing material but a refractory metal or its alloy. An embodiment of an embodiment in which a backside reflecting electrode corresponding to the backside reflecting electrode is further provided is shown in FIG. 4.

In the ion source of this embodiment, a backside reflecting electrode 44 equipped with a function of reflecting the electrons in the plasma generating chamber 2 is further provided at the back of the electron emitting portion of the hot cathode 12 in the plasma generating chamber 2. This backside reflecting electrode 44 is provided to oppose to the opposing reflecting electrode 20, and is isolated electrically from the plasma generating chamber 2. The negative voltage that is negative in contrast to the potential of the plasma generating chamber 2 is applied to the backside reflecting electrode 44 (or the backside reflecting electrode 44 is set to a floating potential, as described above). This backside reflecting electrode 44 is formed of the aluminum containing material, as described above.

As the means for supporting the backside reflecting electrode 44 in the plasma generating chamber 2 while isolating electrically from the plasma generating chamber 2, the publicly known means can be employed. In this embodiment, the backside reflecting electrode 44 is supported by an insulator 48, which is also used as a current introducing terminal, as an example, but the supporting means is not limited to this. In an embodiment shown in FIG. 5, an illustration of the supporting means of the backside reflecting electrode 44 is omitted.

The electron emitting portion of the hot cathode 12 denotes the portion, which emits particularly many thermions, of the hot cathode 12. Concretely, the electron emitting portion corresponds to a top end portion of the hot cathode 12 (a top end portion on the inside of the plasma generating chamber 2). In the case of the indirectly heated type hot cathode 12, the electron emitting portion corresponds to a top end portion of the cathode member 36 (a top end portion on the inside of the plasma generating chamber 2).

In this embodiment, the backside reflecting electrode 44 has a hole 46 through which the hot cathode 12 (more concretely, its leg portion) passes while keeping electric insulation. A clearance of about 3 mm, for example, is provided between the hot cathode 12 and the backside reflecting electrode 44. Therefore, it is possible to say that the backside reflecting electrode 44 is provided in vicinity of the hot cathode 12.

In this event, (a) the bias voltage $V_B$ that is negative in contrast to the potential of the plasma generating chamber 2 may be applied to the backside reflecting electrode 44 from the bias power supply 24 while using the bias power supply 24 commonly as the opposing reflecting electrode 20, like the example shown in FIG. 4, or (b) the bias voltage that is negative in contrast to the potential of the plasma generating chamber 2 may be applied to the backside reflecting electrode 44 from the DC bias power supply that is different from the bias power supply 24, or (c) the voltage that is negative in contrast to the potential of the plasma generating chamber 2 may be applied to the backside reflecting electrode 44 by connecting the backside reflecting electrode 44 to the connection portion a or b, like the case of the opposing reflecting electrode 20 shown in FIG. 2.

Alternately, instead of the application of the negative voltage to the backside reflecting electrode 44, the backside reflecting electrode 44 may not be connected to any portion and may be set at a floating potential. Even when the backside reflecting electrode 44 is set to a floating potential, the electrons whose mass is lighter than the ions in the plasma 4 and whose mobility is higher that such ions are incident on the backside reflecting electrode 44 in an amount that is greater than the ions, like the case of the opposing reflecting electrode 20 that is set at a floating potential. Therefore, the backside reflecting electrode 44 is charged negatively, and the similar action to the case where the negative voltage is applied to the backside reflecting electrode 44 can be achieved.

That is, like the case of the opposing reflecting electrode 20, the backside reflecting electrode 44 can perform an action of reflecting the electrons in the plasma generating chamber 2.

In addition, the backside reflecting electrode 44 is exposed to the plasma 4, which is generated by ionizing the ionization gas 8 containing the fluorine, during the operation of the ion source. In addition, the backside reflecting electrode 44 is formed of the aluminum containing material. Therefore, according to the similar action to that described with respect to the opposing reflecting electrode 20, i.e., on account of the erosion caused by the fluorine ion, the fluorine radical, and the like in the plasma 4, the sputtering caused by the ions such as the fluorine ion, and the like in the plasma 4, etc., the aluminum particles are emitted from the backside reflecting electrode 44 into the plasma 4. In other words, areas of the aluminum containing material, which undergo the erosion or the sputtering by the fluorine ions, etc. in the plasma 4, can be increased rather than the case where only the opposing reflecting electrode 20 is formed of the aluminum containing material. As a result, an amount of aluminum ions contained in the ion beam 34, i.e., an amount of aluminum ion beam, can be increased by increasing an amount of aluminum particles that are emitted into the plasma 4.

Also, the hot cathode 12 is provided in vicinity of the backside reflecting electrode 44, as described above, and a temperature of the backside reflecting electrode 44 is increased by a radiant heat from the hot cathode 12. As a result, an improvement of a sputter ratio and an increase of a vapor pressure of the aluminum containing material can be expected, and thus an amount of aluminum particles that are emitted into the plasma 4 can be increased. Therefore, an amount of aluminum ions contained in the ion beam 34 can be increased from this viewpoint.

In short, the reason why an improvement of a sputter ratio of the backside reflecting electrode 44 can be expected when heated to a high temperature is that a lattice vibration the aluminum atoms and other atoms of the aluminum containing material constituting the backside reflecting electrode 44 becomes active when heated to a high temperature, and thus a chemical bond between these atoms is easily cut and the aluminum particles are ready to run out.

Also, the reason why an increase of a vapor pressure of the aluminum containing material can be expected when heated to a high temperature is that, when the backside reflecting electrode 44 is heated to a high temperature, the aluminum particles are easily emitted from the aluminum containing material into the atmosphere (i.e., the vacuum atmosphere in the plasma generating chamber 2) along with the similar phenomenon that is produced in an increase of a vapor pressure. Therefore, although the aluminum particle being emitted from the aluminum containing material constituting the backside reflecting electrode 44 along with the above action is not strictly defined as a vapor, such event is mentioned as an increase of a vapor pressure like the case of vapor.

Also, in the case of the embodiment, the backside reflecting electrode 44 equipped with a function of reflecting the electrons in the plasma generating chamber 2 is also used as the aluminum particle emitting electrode. Therefore, unlike the ion source in the related art, there is no need that the plate used exclusively to generate the aluminum ions should be particularly provided. As a result, a reduction of the number of items and a simplification of the structure of the ion source can be attained in contrast to the case where such plate is particularly provided.

Figure 5:
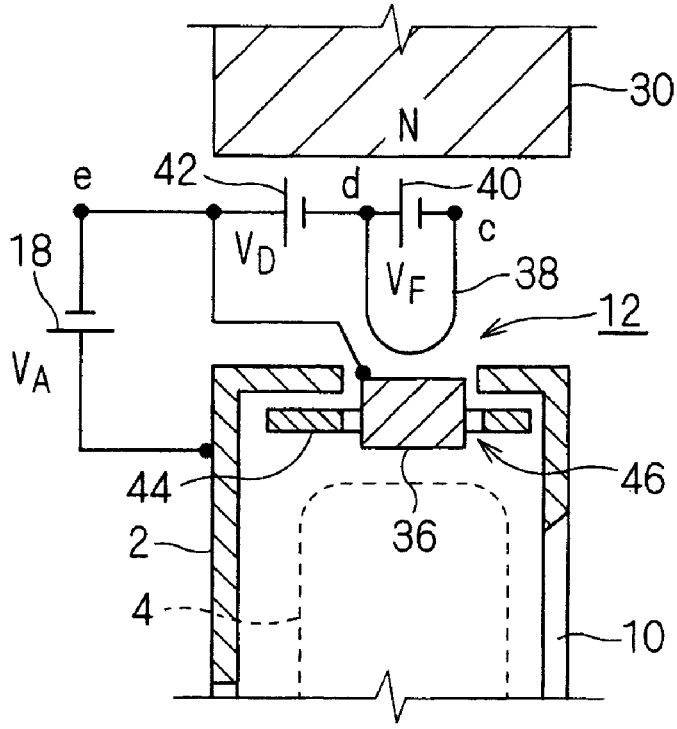
FIG. 5 is a schematic sectional view showing another embodiment when a hot cathode is of an indirectly heated type.

Such an embodiment is shown in FIG. 5 that the above the backside reflecting electrode 44 is provided in addition to the opposing reflecting electrode 20 and also the hot cathode 12 is the indirectly heated type.

This hot cathode 12 has an almost similar structure to that of the hot cathode 12 shown in FIG. 3. But the cathode member 36 is arranged in the plasma generating chamber 2 in this embodiment. Also, the backside reflecting electrode 44 that is electrically isolated from the plasma generating chamber 2 is provided at the back of the electron emitting portion of the hot cathode 12 (i.e., as described above, the top end portion of the cathode member 36) to oppose to the opposing reflecting electrode 20 (see FIG. 4, etc.). In other words, it is possible to say that the backside reflecting electrode 44 is provided at the side back of the top end portion of the cathode member 36. This provision is contained in the term "back" in this specification.

In this embodiment, the backside reflecting electrode 44 has the hole 46 through which the cathode member 36 passes while keeping electric insulation. A clearance of about 3 mm, for example, is provided between the cathode member 36 and the backside reflecting electrode 44. Therefore, it is possible to say that the backside reflecting electrode 44 is provided in vicinity of the hot cathode 12, more concretely, the cathode member 36.

In this embodiment, the negative voltage that is negative in contrast to the potential of the plasma generating chamber 2 may be applied to the backside reflecting electrode 44 like the case of the embodiment shown in FIG. 4, or the backside reflecting electrode 44 may not be connected electrically to any portion and may be set at a floating potential. When the negative voltage is to be applied, (a) the negative bias voltage $V_B$ may be applied from the bias power supply 24, (b) the negative bias voltage may be applied from the DC bias power supply different from the bias power supply 24, or (c) the backside reflecting electrode 44 may be connected to the connection portion e, d, or c, like the case of the embodiment shown in FIG. 3. Indeed, there is no necessity that, when the backside reflecting electrode 44 fulfills the similar action to that explained in the embodiment in FIG. 4, the negative voltage that is large enough to contain the output voltage $V_D$ should be applied to the backside reflecting electrode 44. Therefore, when the backside reflecting electrode 44 is connected to the connection portion e and the arc voltage $V_A$ is applied thereto, the bias voltage has sufficient amplitude.

In the case of this embodiment, the almost similar advantages of the backside reflecting electrode 44 to those explained in the embodiment in FIG. 4 can be attained. That is, in addition to the action of reflecting the electrons in the plasma generating chamber 2, an amount of aluminum ions contained in the ion beam 34 (see FIG. 4) can be increased by increasing an amount of aluminum particles being emitted into the plasma 4. Such an event is similar to the above that, because the hot cathode 12 is located in the neighborhood, a temperature of the backside reflecting electrode 44 is increased and thus an amount of aluminum particles emitted into the plasma 4 is increased. Also, the backside reflecting electrode 44 is also used as the electrode that is used to emit the aluminum particles. As a result, a reduction of the number of items and a simplification of the structure of the ion source can be attained.

Figure 6:
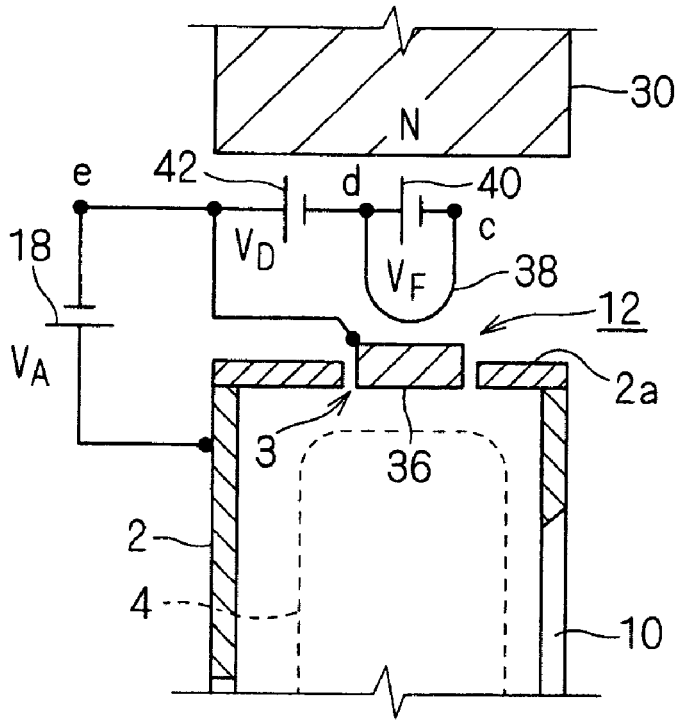
FIG. 6 is a schematic sectional view showing still another embodiment when a hot cathode is of an indirectly heated type.

In an embodiment shown in FIG. 6, the cathode member 36 of the hot cathode 12 is arranged in an opening portion 3 of the plasma generating chamber 2. A wall surface 2*a* containing the opening portion 3 (more concretely, one side surface containing the opening portion 3) of the plasma generating chamber 2 is composed of the electric insulating aluminum containing material. The electric insulating aluminum containing material is the aluminum compound such as aluminum oxide ($Al_2O_3$), aluminum nitride (AlN), or the like, for example.

The wall surface 2*a* composed of the aluminum containing material is electrically isolative, and thus is set at a floating potential. Like the case of the backside reflecting electrode 44 at the floating potential described above, the electrons whose mass is lighter than the ions in the plasma 4 and whose mobility is higher that such ions are incident on the wall surface 2*a* in an amount that is greater than the ions. Therefore, the wall surface 2*a* is charged negatively.

Accordingly, like the case of the backside reflecting electrode 44, this wall surface 2*a* can also attain the action of reflecting the electrons in the plasma generating chamber 2. In addition to this, such an advantage can be attained that an amount of aluminum ions contained in the ion beam 34 is increased by increasing an amount of aluminum particles being emitted into the plasma 4. This advantage will be explained together with an embodiment shown in FIG. 7.

Figure 7:
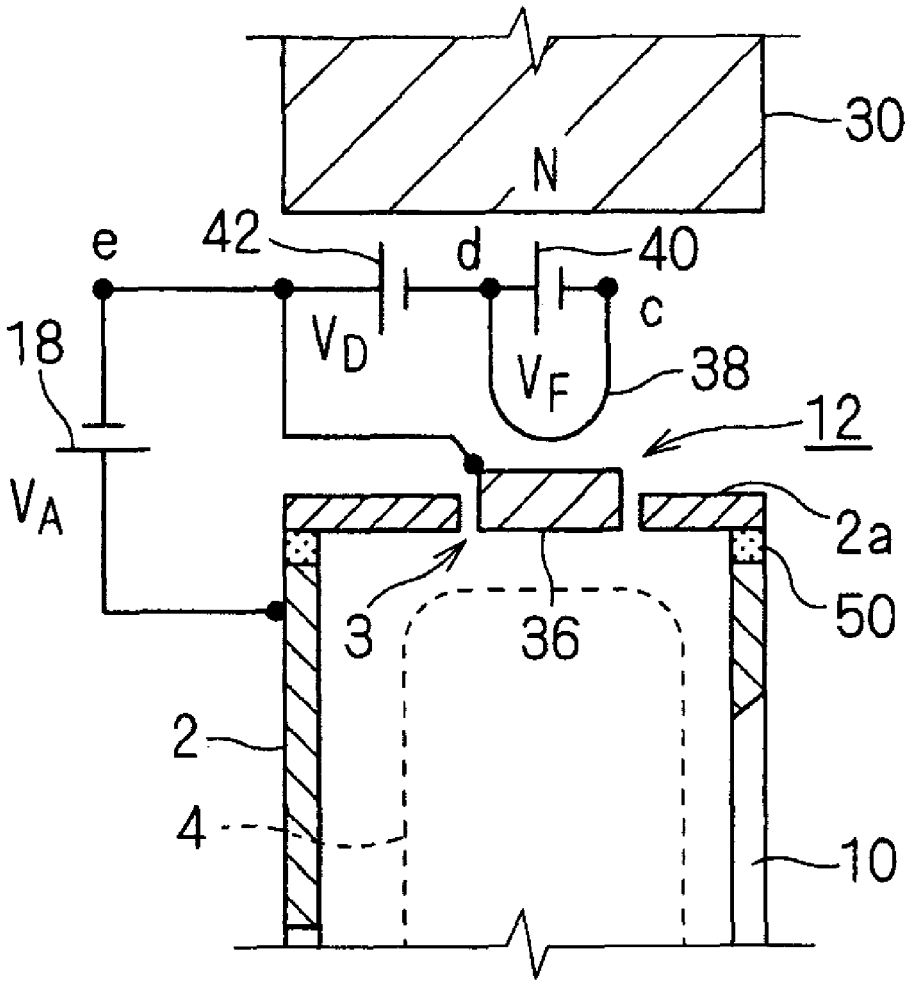
FIG. 7 is a schematic sectional view showing further embodiment when a hot cathode is of an indirectly heated type.

In an embodiment shown in FIG. 7, the wall surface 2*a* containing the opening portion 3 of the plasma generating chamber 2 is formed of the aluminum containing material, and is electrically isolated from the other wall surface of the plasma generating chamber 2 with intervention of an insulator 50. In this embodiment, the aluminum containing material may be electric isolative or conductive.

Like the case of the backside reflecting electrode 44 in the embodiment shown in FIG. 5, the negative voltage that is negative in contrast to the potential of the plasma generating chamber 2 may be applied to the wall surface 2*a* being composed of the aluminum containing material, or the wall surface 2*a* may not be connected electrically to any portion and may be set at a floating potential. When the negative voltage is to be applied, (a) the negative bias voltage $V_B$ may be applied from the bias power supply 24, (b) the negative bias voltage may be applied from the DC bias power supply different from the bias power supply 24, or (c) the wall surface 2*a* may be connected to the connection portion e, d, or c. For example, the wall surface 2*a* may be connected to the connection portion e for the similar reason.

When the wall surface 2*a* is set at a floating potential, the wall surface 2*a* can be charged negatively by the same action as that in the case of the wall surface 2*a* in the embodiment shown in FIG. 6. Therefore, the same advantages as those in the case where the negative voltage is applied to the wall surface 2*a* can be attained.

In other words, like the case of the backside reflecting electrode 44, or the like, the wall surface 2*a* performs the action of reflecting the electrons in the plasma generating chamber 2.

Further, in the case of both embodiments shown in FIG. 6 and FIG. 7, the wall surface 2*a* composed of the aluminum containing material is exposed to the plasma 4, which is generated by ionizing the ionization gas 8 containing the fluorine, during the operation of the ion source. Therefore, according to the similar action to that described with respect to the opposing reflecting electrode 20 and the backside reflecting electrode 44, i.e., on account of the erosion caused by the fluorine ion, the fluorine radical, and the like in the plasma 4, the sputtering caused by the ions such as the fluorine ion, and the like in the plasma 4, etc., the aluminum particles are emitted from the wall surface 2*a* formed of the aluminum containing material into the plasma 4. In other words, areas of the aluminum containing material, which undergo the erosion or the sputtering by the fluorine ions, etc. in the plasma 4, can be increased in contrast to the case where only the opposing reflecting electrode 20 is formed of the aluminum containing material. As a result, an amount of aluminum ions contained in the ion beam 34, i.e., an amount of aluminum ion beams, can be increased by increasing an amount of aluminum particles that are emitted into the plasma 4.

Also, the hot cathode 12 (concretely, the cathode member 36, etc.) is provided in vicinity of the wall surface 2*a* formed of the aluminum containing material, and a temperature of the wall surface 2*a* is increased by a radiant heat from the hot cathode 12. As a result, like the case of the backside reflecting electrode 44, an improvement of a sputter ratio of the wall surface 2*a* and an increase of a vapor pressure of the aluminum containing material can be expected, and thus an amount of aluminum particles that are emitted into the plasma 4 can be increased. Therefore, an amount of aluminum ions contained in the ion beam 34 can be increased from this viewpoint.

Also, in the case of both embodiments shown in FIG. 6 and FIG. 7, a part of the wall surface constituting the plasma generating chamber 2, i.e., the wall surface 2*a* containing the opening portion 3, is also used as the plate that is used to emit the aluminum particles. Therefore, unlike the ion source in the related art, there is no need that the plate used exclusively to generate the aluminum ions should be particularly provided. As a result, a reduction of the number of items and a simplification of the structure of the ion source can be attained rather than the case where such plate is particularly provided.

In the comparison between both embodiments in FIG. 6 and FIG. 7, since the insulator 50 is not needed, a structure in the embodiment in FIG. 6 is simpler than that in the embodiment in FIG. 7. Conversely, since the insulator 50 is provided, the electric isolation between the wall surface 2*a* and the other wall surface of the plasma generating chamber 2 can be provided in the embodiment in FIG. 7 more surely than that in the embodiment in FIG. 6.

Such a structure may be employed that a creeping distance is increased by providing a groove, for example, on a surface of the insulator 50 on the inside of the plasma generating chamber 2. With such structure, it can be suppressed that the insulating performance is lowered due to a contamination on the surface of the insulator 50.

What is claimed is:

1. An ion source for generating an ion beam containing an aluminum ion, comprising:

a plasma generating chamber which is also used as an anode and generates a plasma in an interior, and into which an ionization gas containing fluorine is introduced;

a hot cathode provided on one side in the plasma generating chamber and isolated electrically from the plasma generating chamber;

an opposing reflecting electrode which is provided on other side in the plasma generating chamber to oppose to the hot cathode and is isolated electrically from the plasma generating chamber, to which a voltage that is negative in contrast to a potential of the plasma generating chamber is applied, and which reflects electrons in the plasma generating chamber and is formed of an aluminum containing material which is a solid state source, and is a first source of implantation ions;

a magnet which generates a magnetic field along a line connecting the hot cathode and the opposing reflecting electrode, in the plasma generating chamber; and a gas inlet port configured to introduce the ionization gas into the plasma generating chamber, wherein the gas inlet port is connected to a wall of the plasma generating chamber apart from the opposing reflecting electrode.

2. An ion source for generating an ion beam containing an aluminum ion, comprising:

a plasma generating chamber which is also used as an anode and generates a plasma in an interior, and into which an ionization gas containing fluorine is introduced;

a hot cathode provided on one side in the plasma generating chamber and isolated electrically from the plasma generating chamber;

an opposing reflecting electrode which is provided on other side in the plasma generating chamber to oppose to the hot cathode and is isolated electrically from the plasma generating chamber, which is set at a floating potential, and which reflects electrons in the plasma generating chamber and is formed of an aluminum containing material which is a solid state source, and is a first source of implantation ions;

a magnet which generates a magnetic field along a line connecting the hot cathode and the opposing reflecting electrode, in the plasma generating chamber; and a gas inlet port configured to introduce the ionization gas into the plasma generating chamber, wherein the gas inlet port is connected to a wall of the plasma generating chamber apart from the opposing reflecting electrode.

3. An ion source according to claim 1, further comprising:

a backside reflecting electrode which is provided at a back of an electron emitting portion of the hot cathode in the plasma generating chamber to oppose to the opposing reflecting electrode, which is isolated electrically from the plasma generating chamber, to which a voltage that is negative in contrast to the potential of the plasma generating chamber is applied, and which reflects the electrons in the plasma generating chamber and is formed of an aluminum containing material which is a solid state source, and is a second source of implantation ions.

4. An ion source according to claim 2, further comprising:

a backside reflecting electrode which is provided at a back of an electron emitting portion of the hot cathode in the plasma generating chamber to oppose to the opposing reflecting electrode, which is isolated electrically from the plasma generating chamber, to which a voltage that is negative in contrast to the potential of the plasma generating chamber is applied, and which reflects the electrons in the plasma generating chamber and is formed of an aluminum containing material which is a solid state source, and is a second source of implantation ions.

5. An ion source according to claim 1, further comprising:

a backside reflecting electrode which is provided at a back of an electron emitting portion of the hot cathode in the plasma generating chamber to oppose to the opposing reflecting electrode, which is isolated electrically from the plasma generating chamber, which is set at a floating potential, and which reflects the electrons in the plasma generating chamber and is formed of an aluminum containing material which is a solid state source, and is a second source of implantation ions.

6. An ion source according to claim 2, further comprising:

a backside reflecting electrode which is provided at a back of an electron emitting portion of the hot cathode in the plasma generating chamber to oppose to the opposing reflecting electrode, which is isolated electrically from the plasma generating chamber, which is set at a floating potential, and which reflects the electrons in the plasma generating chamber and is formed of an aluminum containing material which is a solid state source, and is a second source of implantation ions.

7. An ion source according to claim 1, wherein the hot cathode is an indirectly heated type hot cathode which has a cathode member which emits thermions by a heating and a filament which heats the cathode member, the cathode member being arranged in an opening portion of the plasma generating chamber, and a wall surface containing the opening portion of the plasma generating chamber is formed of an electric insulating aluminum containing material.

8. An ion source according to claim 2, wherein the hot cathode is an indirectly heated type hot cathode which has a cathode member which emits thermions by a heating and a filament which heats the cathode member, the cathode member being arranged in an opening portion of the plasma generating chamber, and a wall surface containing the opening portion of the plasma generating chamber is formed of an electric insulating aluminum containing material.

9. An ion source according to claim 1, wherein the hot cathode is an indirectly heated type hot cathode which has a cathode member which emits thermions by a heating and a filament which heats the cathode member, the cathode member being arranged in an opening portion of the plasma generating chamber, and a wall surface containing the opening portion of the plasma generating chamber is formed of an aluminum containing material, and is insulated electrically from other wall surfaces of the plasma generating chamber with intervention of an insulator and is set at a floating potential.

10. An ion source according to claim 2, wherein the hot cathode is an indirectly heated type hot cathode which has a cathode member which emits thermions by a heating and a filament which heats the cathode member, the cathode member being arranged in an opening portion of the plasma generating chamber, and a wall surface containing the opening portion of the plasma generating chamber is formed of an aluminum containing material, and is insulated electrically from other wall surfaces of the plasma generating chamber with intervention of an insulator and is set at a floating potential.

11. An ion source according to claim 1, wherein the hot cathode is an indirectly heated type hot cathode which has a cathode member which emits thermions by a heating and a filament which heats the cathode member, the cathode member being arranged in an opening portion of the plasma generating chamber, a wall surface containing the opening portion of the plasma generating chamber is formed of an aluminum containing material, and is insulated electrically from other wall surfaces of the plasma generating chamber with intervention of an insulator, and a voltage that is negative in contrast to the potential of the plasma generating chamber is applied to the wall surface formed of the aluminum containing material.

12. An ion source according to claim 2, wherein the hot cathode is an indirectly heated type hot cathode which has a cathode member which emits thermions by a heating and a filament which heats the cathode member, the cathode member being arranged in an opening portion of the plasma generating chamber, a wall surface containing the opening portion of the plasma generating chamber is formed of an aluminum containing material, and is insulated electrically from other wall surfaces of the plasma generating chamber with intervention of an insulator, and a voltage that is negative in contrast to the potential of the plasma generating chamber is applied to the wall surface formed of the aluminum containing material.

13. An ion source according to claim 1, wherein components of the opposing reflecting electrode consist of a composition different from that of the ionization gas.

14. An ion source according to claim 2, wherein components of the opposing reflecting electrode consist of a composition different from that of the ionization gas.

* * * * *